US011672727B2

(12) United States Patent
Driscoll et al.

(10) Patent No.: US 11,672,727 B2
(45) Date of Patent: Jun. 13, 2023

(54) DATA ACQUISITION AND ANALYSIS OF HUMAN SEXUAL RESPONSE USING A PERSONAL MASSAGING DEVICE

(71) Applicant: Sternidae Industries, LLC, Emeryville, CA (US)

(72) Inventors: Jonathan Daniel Driscoll, San Diego, CA (US); Aaron Tynes Hammack, Berkeley, CA (US)

(73) Assignee: DIMENSIONAL INDUSTRIES, INC., San Diego, CA (US)

( * ) Notice: Subject to any disclaimer, the term of this patent is extended or adjusted under 35 U.S.C. 154(b) by 196 days.

(21) Appl. No.: 17/156,200

(22) Filed: Jan. 22, 2021

(65) Prior Publication Data

US 2021/0212885 A1 Jul. 15, 2021

Related U.S. Application Data

(63) Continuation of application No. 14/852,410, filed on Sep. 11, 2015, now Pat. No. 10,940,077, which is a (Continued)

(51) Int. Cl.
*A61H 19/00* (2006.01)
*A61H 23/02* (2006.01)

(52) U.S. Cl.
CPC ..... *A61H 19/00* (2013.01); *A61H 23/02* (2013.01); *A61H 2201/018* (2013.01); (Continued)

(58) Field of Classification Search
CPC ..... A61H 23/00; A61H 19/34; A61H 19/32; A61H 1/00; A61H 19/00; A61H 2201/5005; A61H 2201/501; A61H 2201/5012; A61H 2201/5035; A61H 2201/5043; A61H 2201/5058; A61H 2201/5061; A61H 2201/5064; A61H 2201/5069; A61H 2201/5071; A61H 2201/5082; A61H 2201/5084; A61H 2201/5097; A61H 2230/00; A61H 2230/045; A61H 2230/105; A61H 2230/208; A61H 2230/505; A61H 2230/605; A61H 2230/655
See application file for complete search history.

(56) References Cited

U.S. PATENT DOCUMENTS 10,940,077 B2 * 3/2021 Driscoll ..... A61H 23/02
2008/0065187 A1 3/2008 Squicciarini
(Continued)

*Primary Examiner* — Christine H Matthews
(74) *Attorney, Agent, or Firm* — Perkins Coie LLP; Colin M. Fowler

(57) ABSTRACT

Methods and systems are disclosed for capturing sensor data collected by a personal massaging device with associated sensors, analyzing the data, determining biofeedback data based on the sensor data, and according to some embodiments generating a sexual response profile based on the biofeedback data and a model of human sexual response. Data may be collected and analyzed for a number of uses, including but not limited to: (1) studying human sexual response, (2) adjusting outputs of the personal massaging device based on preset conditions, (3) treating sexual dysfunction conditions, and (4) improving sexual experiences.

20 Claims, 10 Drawing Sheets

Related U.S. Application Data continuation-in-part of application No. 14/065,377, filed on Oct. 28, 2013, now abandoned.

(60) Provisional application No. 62/049,945, filed on Sep. 12, 2014.

(52) U.S. Cl.
CPC ..... *A61H 2201/501* (2013.01); *A61H 2201/5005* (2013.01); *A61H 2201/5012* (2013.01); *A61H 2201/5035* (2013.01); *A61H 2201/5043* (2013.01); *A61H 2201/5048* (2013.01); *A61H 2201/5058* (2013.01); *A61H 2201/5061* (2013.01); *A61H 2201/5064* (2013.01); *A61H 2201/5069* (2013.01); *A61H 2201/5071* (2013.01); *A61H 2201/5082* (2013.01); *A61H 2201/5084* (2013.01); *A61H 2201/5092* (2013.01); *A61H 2201/5097* (2013.01); *A61H 2230/00* (2013.01); *A61H 2230/045* (2013.01); *A61H 2230/105* (2013.01); *A61H 2230/208* (2013.01); *A61H 2230/505* (2013.01); *A61H 2230/605* (2013.01); *A61H 2230/655* (2013.01)

(56) References Cited

U.S. PATENT DOCUMENTS

| | | | | |
|---|---|---|---|---|
| 2013/0110266 | A1 | 5/2013 | Snaterse et al. | |
| 2013/0331745 | A1 | 12/2013 | Sedic | |
| 2014/0046127 | A1 | 2/2014 | Topolovac et al. | |
| 2015/0328081 | A1* | 11/2015 | Goldenberg ..... | A61H 23/02 600/38 |

* cited by examiner

100

DATA ACQUISITION AND ANALYSIS OF HUMAN SEXUAL RESPONSE USING A PERSONAL MASSAGING DEVICE

PRIORITY PATENT APPLICATIONS

This application is a continuation application of U.S. patent application Ser. No. 14/852,410, filed Sep. 11, 2015, which claims priority to U.S. Provisional Patent Application Ser. No. 62/049,945; filed Sep. 12, 2014.

U.S. patent application Ser. No. 14/852,410 is a continuation-in-part application of U.S. patent application Ser. No. 14/065,377; filed Oct. 28, 2013. This present patent application claims priority from the referenced patent applications. The entire disclosure of the referenced patent applications is considered part of the disclosure of the present application and is hereby incorporated by reference herein in its entirety.

TECHNICAL FIELD

The present disclosure relates to acquisition and analysis of biofeedback data related to human sexual response using a personal massaging device with associated sensors.

BACKGROUND

Sexuality is an important component of emotional and physical existence that most people desire to experience in some way throughout their life. However, due to social conventions, many people have trouble discussing sexuality openly. It is, therefore, not surprising that human sexuality and the physiology behind human sexual response remain relatively neglected areas of study. This has led to a dearth of data and a lack of deep understanding into how the human body responds to sexual stimulation.

While art exists, primarily in the area of medical devices, for capturing biofeedback data such as electrocardiograms, the art fails to disclose doing so using a personal massaging device with associated sensors and analyzing the data to gain insight into human sexual response.

SUMMARY

Methods and systems described herein are directed acquiring and analyzing data related to human sexual response using a personal massaging device, associated sensors, and according to some embodiments, other computing devices. Some embodiments are directed at a method that includes receiving a plurality of sensor profiles from a plurality of sensors associated with a personal massaging device, while a person is using the personal massaging device; analyzing the plurality of sensor profiles; determining a biofeedback data based on the analysis of the plurality of sensor profiles; and outputting the biofeedback data. Some embodiments are directed at generating a sexual response profile of the person based on the output biofeedback data and a model of human sexual response. Some embodiments are directed at transmitting the biofeedback data to a remote data analytics platform where the biofeedback data is aggregated with biofeedback data from others and analyzed. Some embodiments are directed at presenting the biofeedback data and sexual response profile to a user via a personal computing device.

BRIEF DESCRIPTION OF THE DRAWINGS

The present embodiments are illustrated by way of example and are not intended to be limited by the figures of the accompanying drawings. In the drawings.

DETAILED DESCRIPTION

Overview

Figure 1:
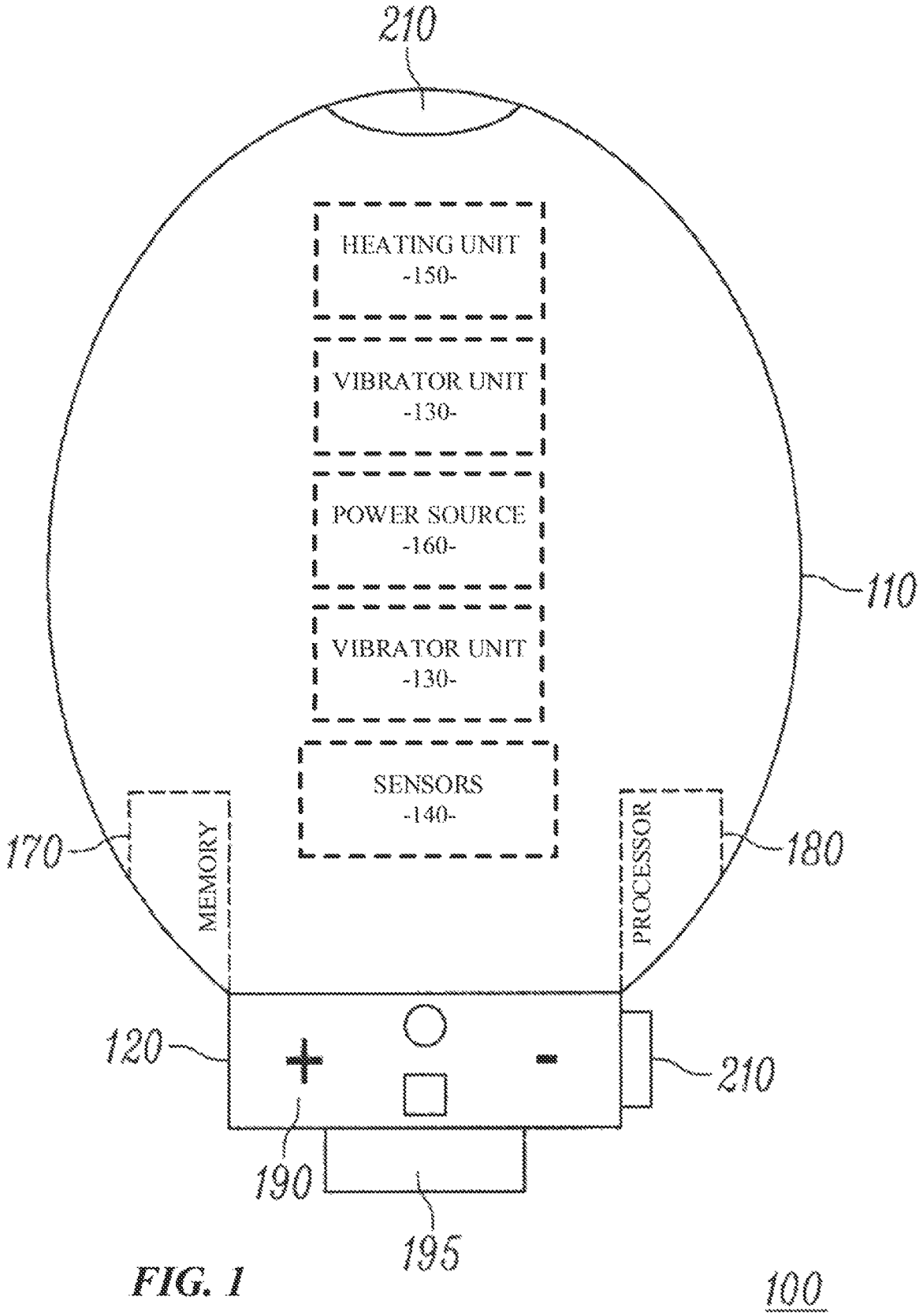
FIG. 1 depicts an exemplary personal massaging device (PMD), according to some embodiments.

From the foregoing, it will be appreciated that specific embodiments of the invention have been described herein for purposes of illustration, but that various modifications may be made without deviating from the scope of the invention. Accordingly, the scope of the invention is not limited except as by the appended claims.

Some embodiments described herein contemplate a personal massaging device (PMD) with associated sensors configured to sense certain physiological responses by a person to stimuli provided by the PMD. According to some embodiments, the sensor data may be analyzed to determine biofeedback data which in turn may be used along with a model of human sexual response to generate a sexual response profile of the person as they use the PMD. Consider the following example. A person begins using a PMD which may produce certain stimuli configured to induce a sexual response in the person, for example, a vibrating sensation. As the stimuli are applied via the PMD, the person's body begins to respond, for example, through increased heart rate, perspiration, and muscle contractions. Through their own senses, the person is obviously aware that their body is responding to the stimuli, however they have no way of determining exactly what is going on. Sensors associated with the PMD may be able to pick up the body's response to the stimuli and convert that response to analog and/or digital information. This information may be analyzed and processed to create biofeedback data that provides insight into how the person's body is responding to the stimuli. Using another computing device such as a tablet device, the person may be able to view in real time their biofeedback data. For example, as the person uses the device, a program instantiated on the tablet device may update in real-time a graphical chart of various biofeedback parameters such as heart rate. Further, the sexual response profile may be displayed graphically via the device so that the person can visualize the stages of their body's sexual response to the stimuli from excitement, through to orgasm and back to pre-excitement levels. Alternatively, the PMD itself, and the processing subsystem therein, can analyze the body's response to the stimuli and generate corresponding biofeedback data. The biofeedback data can be used by the PMD to produce or configure subsequent PMD actions or functions. As a result, the example embodiments of the PMD as described herein, can provide stimuli to the user, sense the user's response to the stimuli, and modify PMD operation or initiate new PMD operations based on the sensed user response. All of these functional features and processing operations can be performed by the PMD itself without support from external processing devices.

According to some embodiments, the biofeedback data may be uploaded to a remote data analytics platform to be aggregated with other sources of data, for example, the biofeedback data from other people using PMDs. This aggregated data may be analyzed to gain even further insight into human sexual response and according to some embodiments, to dynamically generate a sophisticated model of human sexual response through machine learning algorithms.

In various example embodiments, the PMD can operate as a standalone device that can develop a customized or learned dataset over time based on use by one or more users. As described above, the example embodiments of the PMD can provide stimuli to the user, sense the user's response to the stimuli, and generate corresponding biofeedback data. Additionally, the PMD can use the data to generate an evolving model of the one or more user's sexual response. The model can then be used by the PMD to customize the subsequent operation and configuration of the PMD to conform to the dynamically generated user model. Again, the generation of the user model and the related processing operations can be performed by the PMD itself without support from external processing devices.

It should be understood that the phrase, "model of human sexual response" as used herein refers both to an historical model of human sexual response and to a dynamically generated sexual response model based on sensor data from one or more users of the personal massaging device as described herein. The historical model of human sexual response, proposed by Masters and Johnson and described in more detail below, was developed by analysis of a large group of people and was typically described as including four basic phases: excitement, plateau, orgasm, and resolution. The historical model is a broad generalization of human sexual response. In contrast, the dynamically generated sexual response model, as described herein and generated by the personal massaging device of various example embodiments, is more narrowly focused on the sexual responses of particular users of a specific personal massaging device. As described in more detail below, various types of stimuli can be generated by the personal massaging device of example embodiments. The user's response to the stimuli can be captured and used to generate the dynamically generated sexual response model, which represents one form of the, "model of human sexual response."

The above described teachings may be used for a number of purposes. For example, according to some embodiments, the data may be used for scientific research into human sexual response. The data may also be used by physicians in order to diagnose and treat certain sexual dysfunction conditions. The data may also be used on a more personal level to enhance the experience of using the PMD. For example, while the data may be visualized via a computing device, it may also be used by the PMD to adjust the ways in which stimuli are applied. As an illustrative example, a system according to the present teachings is able to recognize the point at which a person is near orgasm and adjust the level of stimulation provided by the PMD to either edge away from the point of orgasm or build in intensity. The specifics of any implementation may vary from device to device and may personalize to each individual using the device according to how that individual's body responds to stimuli. The data may also be used on a personal level as a therapeutic tool to treat certain sexual dysfunctions. By providing active feedback to the person using the PMD (as well as adjusting the provided stimuli), a system according to the present teachings may be able to guide the person towards achieving a particular target sexual response.

Personal Massaging Device

FIG. 1 illustrates an exemplary personal massaging device (herein referred to as a PMD) 100, according to some embodiments of the present disclosure. As shown in FIG. 1, the PMD 100 may include a main body 110 that may house electronics and power source(s) 160 to operate the device.

PMD 100 may include one or more stimulation unit(s) 130 which may be configured to create a stimulus output which may cause a physiological response by a user. According to some embodiments, the stimulation unit(s) 130 may be configured to cause a sexual response (e.g. arousal, orgasm, etc.) by the user. Stimulation unit(s) may include, but are not limited to: vibrator motors (that may cause the PMD to vibrate), heat sources 150 (that may cause the PMD to heat up), electromyostimulation devices (that may cause muscle stimulation through the application of electrical current via electrodes in contact with the body of a user), and any other devices configured to provide an output that may cause a physiological response in a human.

PMD 100 may include or be associated with one or more sensor(s) 140. Sensors 140 may include, but are not limited to: electric biopotential sensors, optical sensors, pressure/force sensors, thermal sensors, moisture sensors, acoustic sensors, chemical sensors and any other sensor types configured to sense one or more aspects of a user's response to a stimulus (e.g. as provided by stimulation unit 130). As an example, for illustrative purposes, the heart rate of a person may be sensed using different types of sensors. Biopotential sensors in contact with the skin of a user may sense the difference in electrical potential caused by the action of the heart. Conversely, an electro optical sensor may sense the difference in reflected light off the skin of a user from a light source (e.g. an infrared (IR) diode) caused by the changing blood volume as the heart beats. These sensors are well known in the art of biofeedback. A person having skill in the art will recognize that number of different sensors may be implemented with a PMD to sense the response of a user to applied stimuli.

In the exemplary embodiment depicted in FIG. 1, the sensor unit(s) 140 are incorporated as part of the body of PMD 100; however, a person having skill in the art will recognize that sensor(s) 140 may be implemented apart from the body of PMD 100 and communicatively connect to the other components of PMD 100 to transmit sensor data. For example, sensor units 140 may be incorporated into other wearable items such as a watch, a ring, earrings, spectacles, clothing, etc., positioned on the body of a user in such a way in order to pick up sensor data. As a non-limiting illustrative example, a smart watch device may include electric potential and optical sensors on the wristband of the watch, which through contact with the skin of a user, may be capable of sensing both the heart rate and blood oxygen levels of the user. Data picked up by these sensors (in either raw or processed form) may then be transmitted to a PMD 100 wirelessly (e.g. via Wi-Fi or Bluetooth).

PMD 100 may also include one or more sensor(s) 140 configured to detect the position, orientation, and/or motion of the PMD 100. Sensor(s) 140 may include, but are not limited to, accelerometers (which may be any combination of accelerometer, gyroscope, and/or compass for sensing positioning and movement of the PMD 100), inertial measurement units (IMUs) (which may be any combination of accelerometers, gyroscopes, and manometers), proximity sensors, global positioning transceivers, and any other sensor device configured to detect the position, orientation, and/or motion of the PMD 100.

PMD 100 may include a handle 120 for the user to hold. Handle 120 can house one or more buttons 190, or other similar control elements, which allow the user to adjust various characteristics of the output of the personal massaging device 100, such as vibration intensity, temperature, or which on-board algorithm is in control of the input-output relationship, etc. The locations of the various components, the handle 120 and main body 110 are depicted in FIG. 1 as merely one example, and various configurations, as well as combinations of hardware, may be employed.

PMD 100 can further include one or more memory unit(s) 170 capable of storing, encoding or carrying a set of instructions for execution by the processor unit 180 of PMD 100, and that may cause the PMD 100 to perform any one or more of the methodologies of the presently disclosed technique and innovation. Examples of memory unit(s) include, but are not limited to, recordable type media such as volatile and non-volatile memory devices, removable and non-removable flash memory drives, hard disk drives, and any combination thereof.

PMD 100 may also include an interface 195 configured to transmit to and receive data from other device via wired and wireless connections. Interface 195 may be configured to mediate data receipt and transmission over a network and/or dedicated point-to-point connection using any known and/or convenient communications protocol supported by the PMD 100 and the remote device. For example, interface 195 may include combinations of hardware and software enabling communication with other devices via wired connections, and wireless connections (e.g., Wi-Fi or Bluetooth)

PMD 100 may also include a processor unit 180. Processor unit 180 may be a programmable processor configured to control the operation of the personal massaging device 100 and its components based on instructions stored in memory unit 170. For example, the processor unit 180 may be a microcontroller ("MCU"), a general purpose hardware processor (e.g. a CPU), a graphics processing unit (GPU), a digital signal processor ("DSP"), an application specific integrated circuit ("ASIC"), field programmable gate array ("FPGA") or other programmable logic device, discrete gate or transistor logic, discrete hardware components, or any combination thereof designed to perform the functions described herein. A general-purpose processor can be a microprocessor, but in the alternative, the processor can be any processor, controller, or microcontroller. A processor can also be implemented as a combination of computing devices, for example, a combination of a DSP and a microprocessor, a plurality of microprocessors, one or more microprocessors in conjunction with a DSP core, or any other such configuration.

System for Analyzing Sexual Response

Figure 2:
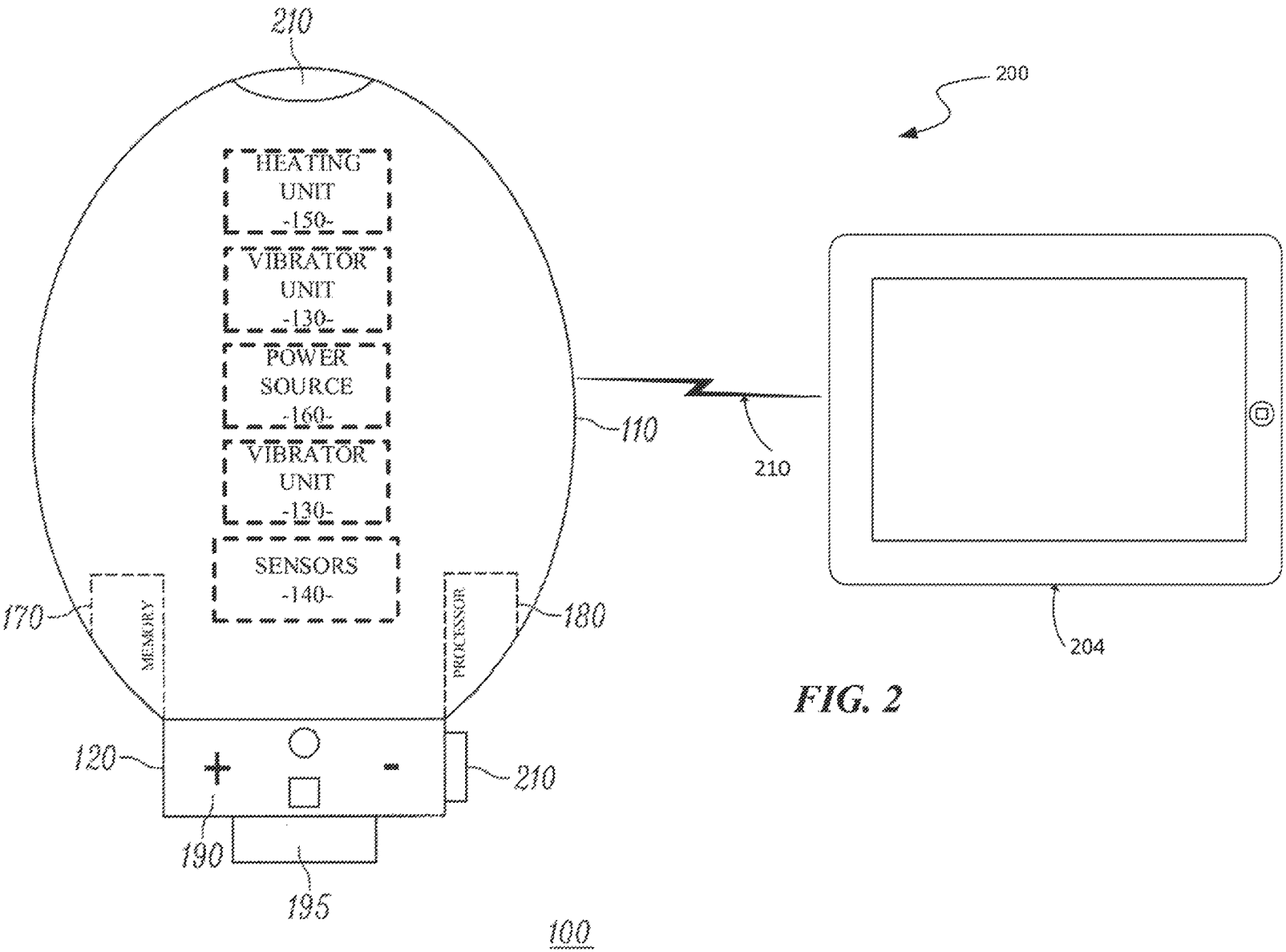
FIG. 2 depicts a high-level conceptual diagram of an example system for analyzing sexual response using a PMD, according to some embodiments.

FIG. 2 illustrates a conceptual diagram of an exemplary system 200 for analyzing sexual response using a PMD, according to some embodiments. As described above, example embodiments of the PMD can be a standalone device that performs all processing operations described herein using its internal data processing system. In particular, the PMD can perform an analysis of the sexual response of one or more users and configure subsequent operations based on this analysis. The details of this analysis are described below. As such, the PMD is designed to be entirely self-sufficient without the need for any connection to an external processing device. Nevertheless, example embodiments can optionally be connected to external devices or to a data network. Various processing operations and data sourcing can then be distributed among the processing systems on a plurality of interconnected devices. A network-enabled embodiment is described next. However, it will be understood by those of ordinary skill in the art, in view of the disclosure herein that the PMD can still operate as a standalone device.

Figure 7:
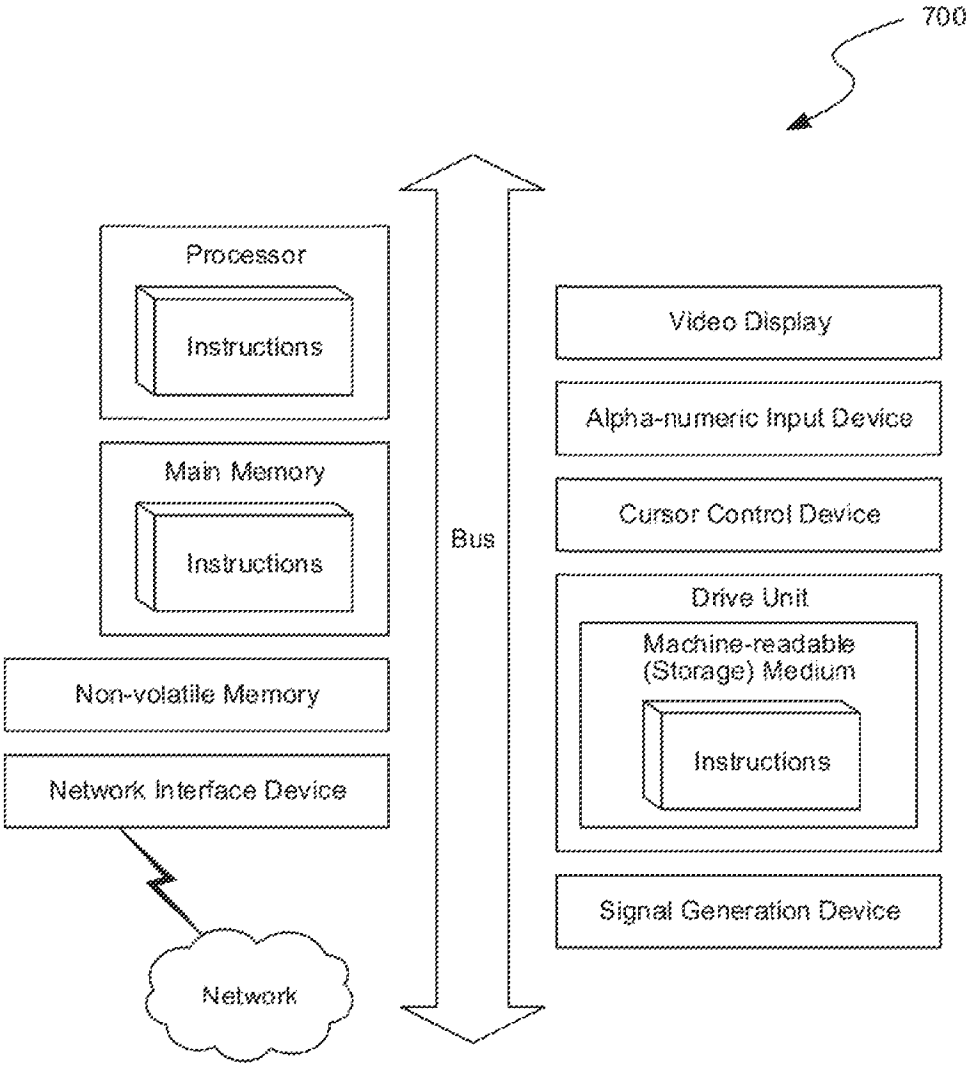
FIG. 7 depicts a diagrammatic representation of an example computing device or system within which a set of instructions, for causing the device or system to perform any one or more of the methodologies discussed herein, can be executed.

According to some embodiments, system 200 may comprise a PMD 100 interfaced with one or more general computing devices 204 via a connection 210. Computing device 204 is illustrated in FIG. 2 as a tablet device (e.g. an iPad®), however computing device 204 may be any combination of hardware and/or software capable of storing a set of instructions and executing processes based on those instructions (as illustrated in FIG. 7 and described in more detail under the section titled "Background Information—Computing Systems/Devices). For example, the computing device 204 may have any following non-limiting list of example device: a server, a desktop computer, a computer cluster, a notebook computer, a laptop computer, a handheld computer, a palmtop computer, a mobile phone, a cell phone, a personal digital assistant (PDA), a smart phone (e.g., iPhone®, etc.), a tablet (e.g., iPad®, etc.), a phablet (e.g., HTC Droid DNA™, etc.), a tablet PC, a thin-client, a game console (e.g. XBOX®, etc.), a hand held gaming device (e.g., Sony Vita), mobile-enabled powered watch (e.g., Apple Watch™, etc.), a smart glass device (e.g., Google Glass™, etc.) and/or any other portable, mobile, hand held devices, etc. running on any platform or any operating system (e.g., OS X, iOS, Windows Mobile, Android, Blackberry OS, Embedded Linux platforms, Palm OS, Symbian platform, Google Chrome OS, etc.).

Computing device 204 may further include input mechanisms (e.g. a touch pad, physical keypad, a mouse, a pointer, a track pad, motion detector, etc.), display devices (e.g. CRT/LCD screen, projector, smart glass display, etc.) and one or more sensors (e.g. an optical sensor, capacitance sensor, resistance sensor, temperature sensor, proximity sensor, a piezoelectric device, device orientation detector (e.g., electronic compass, tilt sensor, rotation sensor, gyroscope, accelerometer), etc.), or a combination thereof.

PMD 100 may connect with one or more computing device(s) 204 via connection 210. In general connection 210 may include any mode of wired or wireless communication over dedicated connection or one or more open or private networks. According to some embodiments, connection between PMD 100 and computing device 204 may be achieved via a dedicated radio-frequency based wireless connection (e.g., using the Bluetooth® standard), via a dedicated wired I/O connection (e.g., Universal Serial Bus (USB), Firewire, Thunderbolt, etc.), via an open wireless network (e.g. a Wi-Fi based local area network connected to the Internet), via an open wired network (e.g. through an Ethernet-based local area network (e.g. using twisted pair cabling links) connected to the Internet), via a closed wireless network (e.g. a Wi-Fi based local area network intranet), or any combination thereof.

As will be described in more detail herein, according to some embodiments of the present disclosure, PMD 100 may, through the use of stimulation unit(s) 130, cause a physiological response in a person using the device, specifically a sexual response. Data (in either a processed or raw form) received from the sensors 140 associated with PMD 100 may be analyzed resulting in biofeedback data associated with the person's response to the stimulus.

The sensor data received from sensors 140 may be referred to herein as a "sensor profile" or merely as sensor data. As used herein, a "sensor profile" may refer to a set of raw and/or processed sensor data associated with one or more particular sensors. For example, a "thermal sensor profile" may include one or more sets of raw and/or processed sensor data from discrete sensors configured to sense temperature or heat. Heat may be sensed using IR optical sensors, electrical resistance thermometers, mechanical thermometers, etc. The combination of which, may produce a "thermal sensor profile." However, the term, "sensor profile" may be used interchangeably with other terms such as "sensor information," "sensor data," "sensor signal," etc.

Sensors 140 may be part of PMD 100 (as illustrated in FIG. 1). However, a person having ordinary skill will recognize that, according to some embodiments, sensors 140 may be part of computing device 204, the data from which may be transmitted to PMD 100 via connection 210 for processing/analysis. Processing and/or analysis of sensor profiles may be performed by one or more processing units at PMD 100 (e.g. processer unit 180) or by one or more processing units at computing device 204. Processing and analysis of the sensor profiles may be handed off between PMD 100 and computing device 204 in a dynamic fashion based on the capabilities of each device. For example, while a person is using a PMD 100, sensors 140 connected to the device may pick up sensor data associated with a sexual response by the person to stimuli provided via stimulation unit(s) 130. The resulting sensor profiles may be analyzed by processer unit 180, but if processing speed at processor 180 begins to lag, sensor profiles may be transmitted (e.g. via connection 210) to computing device 204 for processing. Thus, as described above, the PMD 100 may operate as a standalone device or may optionally employ the data processing capabilities of one or more connected external devices.

Figure 6:
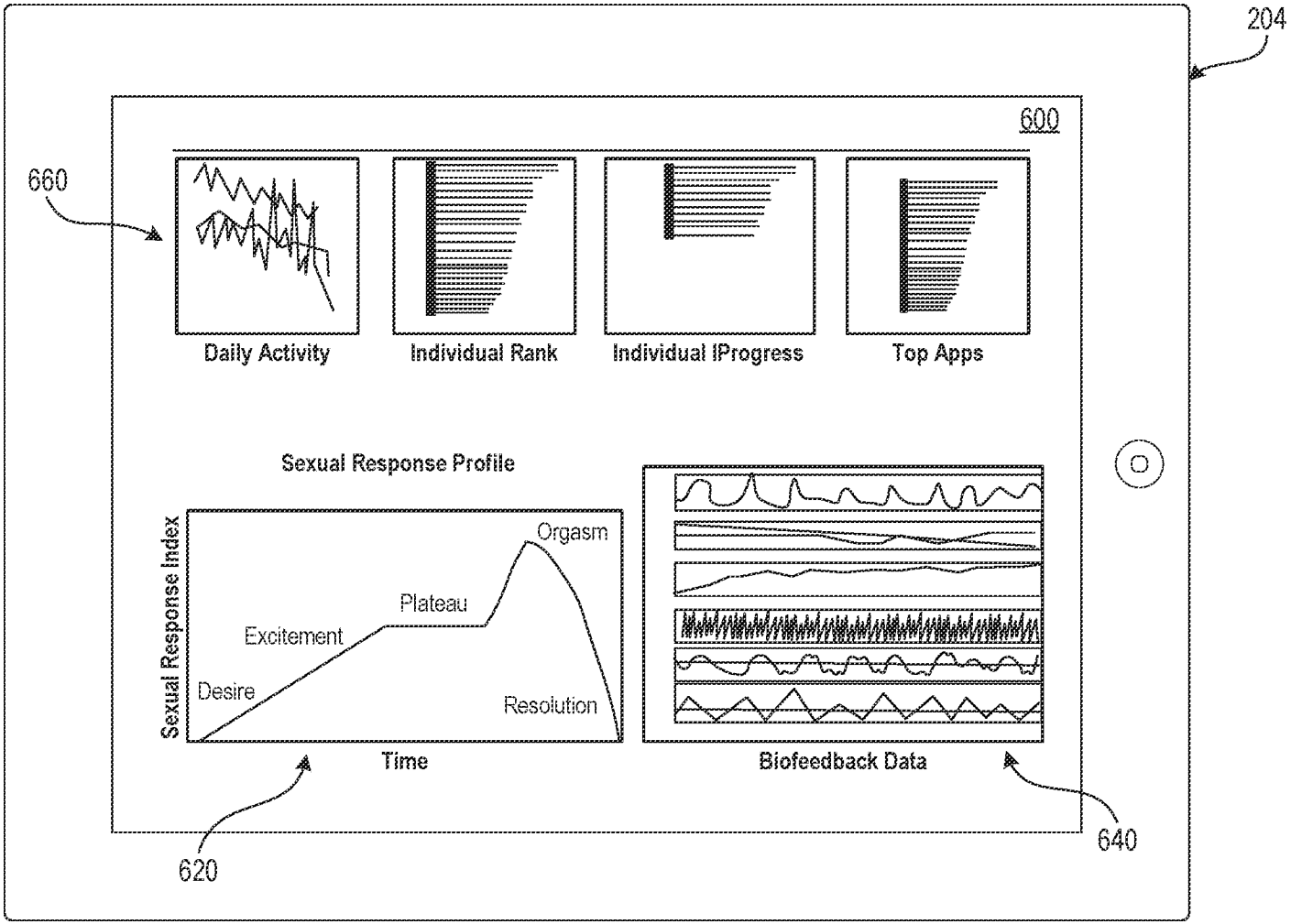
FIG. 6 depicts an example graphical interface and dashboard of a computing device, according to some embodiments.

Biofeedback data based on the received sensor profiles may be presented to a user via a computing device 204. As will be described herein, biofeedback data may represent a processed form of the one or more sensor profiles received from sensors 140. For example, raw and/or processed pressure sensor data representing a pressure sensor profile may be analyzed and result in biofeedback data indicative of contraction of certain muscles. According to some embodiments, biofeedback data may include a chart of quantitative values related to one more sensor profiles. For example, an electrocardiograph (ECG). Such biofeedback data may include one or more rendered graphical components configured to be displayed via a computing device 204. As explained previously, processing may be handled by processor unit 180 at PMD and/or by processing capabilities at the computing device 204. For example, one or more sensor data profiles received from sensors 140 may be analyzed at processor unit 180 to produce biofeedback data based on the one or more sensor profiles (e.g. one or more charts over time for biofeedback such as temperature, applied pressure, heart rate, acceleration of the PMD, etc.). The resulting biofeedback data may be transferred (e.g. via connection 210) for further processing (e.g., rendering by a GPU of computing device 204). The rendered biofeedback data may then be presented to a user via the display of computing device 204. For example, as illustrated in FIG. 6, an example display device 204 (illustrated as a tablet device) may present a graphical dashboard 600 via the display of computing device 204, which may include information based on the sensor profiles received from sensors 140 while a person is using PMD 100. Specifically, dashboard 600 may present, among other data, biofeedback data **640*a*** including various charts of useful data (e.g. temperature, applied pressure, heart rate, acceleration of the PMD, etc.).

As will be described further herein, a sexual response profile describing the person's response to the stimuli provided by the stimulation unit 130 may be generated based on the biofeedback data and a model of human sexual response. As with the biofeedback data, the sexual response profile for the person may be generated by processor unit 180 of PMD 100 and/or processor units on computing device 204. Again, similar to the biofeedback data, the resulting sexual response profile may be presented to a user via a display of computing device 204. For example, as illustrated in FIG. 6, a chart 620 based on the sexual response profile may be graphically displayed as part of a dashboard 600 via the display of computing device 204. The chart in FIG. 6 charts the person's level of sexual response over time identifying phases normally of a human sexual response cycle, namely, excitement, plateau, orgasm, and resolution. According to some embodiments, the sexual response profile may be updated in near real time as the person progresses through their sexual experience using PMD 100. The presentation of sexual response profile 620, as illustrated in FIG. 6, represents an exemplary illustrative embodiment and is not intended to be limiting. Some embodiments, for example, may include a quantitative score indicating level of sexual excitement that may raise and lower depending on the biofeedback data from the person using the PMD 100. Other embodiments may, for example, graphical elements such as symbols or animations based on the biofeedback data form the person. The intention of the sexual response profile is to present a user with a clear indicator of sexual response that distills the sensor profile-based biofeedback data into an understandable format.

Figure 3A:
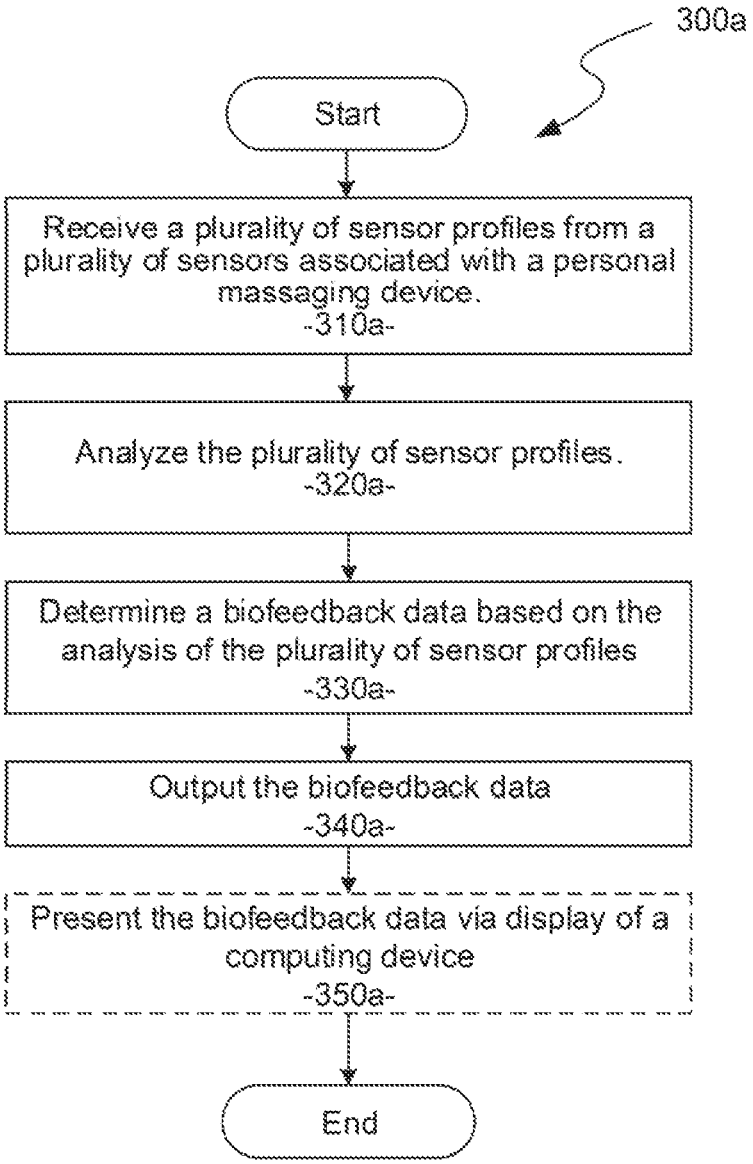
FIG. 3A depicts a flow chart of an example method for analyzing sexual response using a PMD, according to some embodiments.

FIG. 3A illustrates a flow chart for an example method **300*a* for analyzing sexual response using a PMD 100**.

At step **310*a* a processing device may receive a plurality of sensor profiles from a plurality of sensors (e.g. sensors 140) associated with PMD 100. As described earlier, according to some embodiments the processing device may be PMD 100 (with associated processor unit 180). However, according to some embodiments, the processing device may be another computing device (e.g. computing device 204 as shown in FIG. 2). According to some embodiments, processing may occur in distributed manner over multiple devices. It shall be understood that "sensor profiles" may include any raw and/or processed sensor data gathered by sensors 140 (as described earlier). The plurality of sensor profiles may be received via an interface connection between discreet devices (e.g. connection 210 as shown in FIG. 2), or via a system bus or other connection between discreet components within a device (e.g. a bus connection (not shown) between sensor 140 and processor unit 180 as shown in FIG. 1**).

At steps 320*a*-330*a*, the processing device may analyze the plurality of sensor profiles and determine a biofeedback data based on the plurality of sensor profiles. Again, analysis of the sensor profiles and the determining of biofeedback data based on those sensor profiles may be performed either by the processing capabilities of PMD 100 (i.e. processor unit 180) or the processing capabilities of other computing devices (e.g. computing device 240). According to some embodiments, processing may occur in distributed manner over multiple devices. The processing units may be programed to execute instructions for analysis and determination of biofeedback data that are stored in memory (e.g. memory unit 170 of PMD 100 or memory units associated with other devices such as computing device 240). Instructions may be updated or changes through downloading new instructions/updates via a device interface (e.g. interface 195 of PMD 100). Instructions may also dynamically evolve over time through the use of machine learning algorithms. As such, analysis of the sensor profiles may improve over time as a machine learning algorithm "learns" how to better analyze the data.

As described earlier, a "sensor profile" may refer to a set of raw and/or processed sensor data associated with one or more particular sensors. For example, a "thermal sensor profile" may include one or more sets of raw and/or processed sensor data from discrete sensors configured to sense temperature or heat. Heat may be sensed using IR optical sensors, electrical resistance thermometers, mechanical thermometers, etc. The combination of which, may produce a "thermal sensor profile." However, the term, "sensor profile" may be used interchangeably with other terms such as "sensor information," "sensor data," "sensor signal," etc.

As described earlier, biofeedback data may represent a processed form of the one or more sensor profiles received from sensors 140. For example, raw and/or processed pressure sensor data representing a pressure sensor profile may be analyzed and result in biofeedback data indicative of contraction of certain muscles. According to some embodiments, biofeedback data may include a chart of quantitative values related to one or more sensor profiles. For example, and electrocardiograph (ECG). Such biofeedback data may include one or more rendered graphical components configured to be displayed via a computing device 204.

As an illustrative example, sensor profiles sensed by sensors 140 may be received by a processor unit 180 in real time. Sensor profiles may either comprise raw data, such as the raw voltage trace of a biopotential signal (e.g., in the case of an electrocardiogram [ECG] or an electrocardiogram [EKG]), or a processed form of the data (such as a normalized voltage trace and/or resolved heart rate in the case of an ECG/EKG). In addition, sensor profile may include information that is semi processed, for example a filtered voltage trace (e.g. filtered using digital signal processing) that reduces extraneous signal noise received at sensor(s) 140.

A person having ordinary skill will recognize that the amount of analysis and processing of sensor profiles may depend on the state in which the data is received. In other words, raw sensor data (e.g. a raw voltage trace) may require greater analysis and processing in order to determine useful biofeedback data (e.g. a chart of heart rate over time). Conversely sensor profiles that comprise pre-processed data may require minimal analysis in order to convert to useful biofeedback data. Consider an example where a computing device 204 (e.g., wearable smart watch device) includes biopotential sensor(s) 140. The biopotential sensors 140 in contact with the skin of a person may produce raw sensor data in the form of raw voltage traces. However, this raw data may be preprocessed (e.g., normalized and converted to a heat rate) by processing units (e.g., a microprocessor) on the smart watch device. This processed sensor data (i.e., a heart rate sensor profile) may be transmitted via Bluetooth to the PMD 100 being used by the person wearing the smart watch device. This processed data in the form of a heart rate may, therefore, require minimal additional analysis and processing to produce biofeedback data (i.e., a heart rate). Minimal analysis and processing may include, for example, charting a stream of heart rate data over time or combining with sensor profiles from other sensors 140 (e.g., those on PMD 100) to resolve discrepancies in measured heart rate. Consider that different sensor types may be used to measure the same biofeedback indicators. For example, the sensors 140 at the smart watch device 204 may be optical sensors measuring heart rate by sensing the change in blood volume under the skin, while sensors 140 at the PMD 100 may be biopotential sensors measuring heart rate by sensing the change in electrical potential at the surface of the skin caused by the beating of the heart. These two sensor profiles may require analysis and processing in order to determine biofeedback data (i.e., a heart rate of the person). Nevertheless, as described above, the PMD 100 may operate as a standalone device. As such, the PMD 100 can be configured to receive the raw sensor data and perform all preprocessing and analysis of the data internally to the PMD 100.

The resulting biofeedback data based on the analysis may therefore represent a processed form of the one or more sensor profiles received from sensors 140. According to some embodiments, the biofeedback data may comprise charts over time against more variables, including but not limited to, heart rate, oxygen level, applied pressure, and temperature, muscle contractions, and any combination thereof. Biofeedback data may further incorporate motion/position/orientation data of the PMD 100 gathered from sensors 140 at PMD 100, which may be indicative of the motion of the body of the person using the PMD 100 and or the manner in which stimulation is being applied. For example, high acceleration readings may indicate elevated excitement on the part of the person using the PMD 100 with an abrupt decrease in acceleration indicating a release at the point of climax. According to some embodiments, biofeedback data may include charts overt time against combined sets of variables that may provide greater insight into the physiological response of the person to stimulation provide by PMD 100. For example, the degree of correlation between sensed muscle contractions (e.g. using biopotential or pressure sensors of sensors 140) and device activity (e.g. sensed using an accelerometer of sensors 140 and/or data from stimulation units 130) may be correlated to chart a newly generated variable (e.g., degree of synchronization between the person and PMD 100) over time.

Techniques used to analyze the sensor profiles (including raw and/or processed data) will be familiar to those having skill in the art. Individual variables may be scaled or transformed, using various psychometric response curves, into regions which are more informative of state. For example, a square root function may be applied to pressure data contained in a pressure sensor profile, to highlight variation in pressure over time when the overall applied pressure at any given moment is relatively small, while keeping the value within a reasonable range when the pressure becomes relatively large.

As previously mentioned, collections of variables can be transformed into other variables. This can take several forms. For example, some transformations can be calculated analytically, such as using the acceleration data from sensor 140 to calculate orientation and/or velocity along an axis. Alternatively, the data from multiple discrete pressure sensors may be transformed to provide data about where along PMD 100 the pressure is being applied.

Common mathematical operations, as well as common filtering operations, may be applied to individual variables. These may include derivative/integral, filtering (high-pass, lowpass, bandpass, with a selectable number of poles, frequencies, etc.), or thresholding or other non-linear techniques. In addition, running statistics, such as the standard deviation of sensed pressure over the last several seconds, may be applied.

As previously mentioned, correlations among and between variables may also be used to create additional variables. These correlations may be in the form or standard linear correlations (such as Pearson's R), cross correlations, or correlations between other derived variables (for instance, pressure time derivative and the velocity). These correlations can be taken over some time-window, typically on the order of several seconds or longer. According to some embodiments, the size of the time window itself can be adjusted dynamically. The newly derived variables can be used in a number of different ways. They can be used to create charts and other visualizations. For example, these may include two-dimensional plots of one or more variables over with time as the independent axis; phase-space graphs, in which two or more variables plotted against each other; or a number of other ways of presenting the biofeedback data.

At step 340*a* the biofeedback determined at step 330*a* may be output. For example, biofeedback data may be output for storage (e.g., at memory unit 170), may be output for further processing (e.g. as part of generating a sexual response profile), or may be output for transmission to another device (e.g. via interface 195).

Optionally, at step 350*a*, the biofeedback data may be presented to a user via a computing device (e.g. computing device 204 as shown in FIGS. 2-3). As described earlier, and with reference to FIGS. 6A-6B, biofeedback data 640*a* may be presented visually to a user as part of a dashboard 600*a-b* via a display of computing device 204. As shown in FIGS. 6A-6B, according to some embodiments, computing device 204 may be a tablet device with a touch screen (e.g., an iPad®). Specifically, dashboard 600*a* may present, among other data, biofeedback data 640*a* including various charts of useful data (e.g. temperature, applied pressure, heart rate, acceleration of the PMD, etc.). It shall be noted that FIGS. 6A-6B represent exemplary embodiments for illustrative purposes, and are not to be construed as limiting. A person having ordinary skill in the art will recognize that there are any number of ways in which to present biofeedback data graphically (or otherwise) via a computing device 204. Visualization software may be configured to present biofeedback data differently depending on the use of the data, the intended audience, capabilities of the computing device, etc. For example, according to some embodiments, a "user" viewing the biofeedback data may be the person using the PMD 100. Here, a person using the PMD 100 may wish to view real-time biofeedback data via a smart watch that they are wearing in order to augment their experience (it may be exciting to the person to "view" their physiological response to stimulation in real time). The limits of the display of the smart watch would of course factor into the way the data is displayed, as would the person's technical understanding. In other words, highly complex charts may be difficult for a person with little scientific training to decipher. However, a simple presentation of a subset of the biofeedback data (e.g. a heart rate as visualized with an animated beating heart) may be presented to augment the user's experience. Alternatively, according to some embodiments, the "user" viewing the biofeedback data may be a scientific researcher or physician viewing the data via a tablet device while a person (the subject or patient) uses a PMD 100. Of course, in such embodiments, biofeedback data may be presented in a highly detailed fashion so that the user may gain useful insight from the data.

Figure 3B:
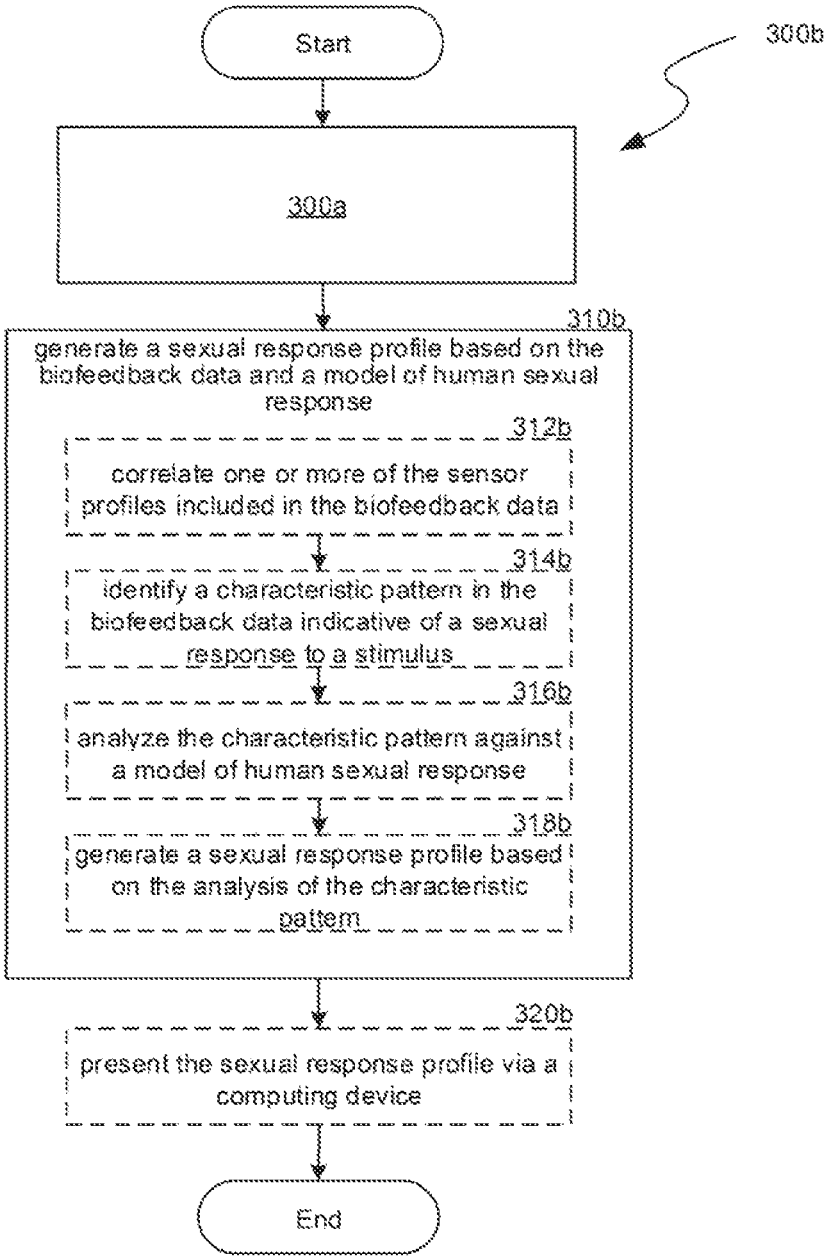
FIG. 3B depicts a flow chart of an example method for analyzing sexual response using a PMD, according to some embodiments.

FIG. 3B illustrates a flow chart for an example method 300*b* for analyzing sexual response using a PMD 100 which builds upon example method 300*a* as illustrated in FIG. 3A.

At step 310*b* a processing device may generate a sexual response profile based on the biofeedback data (e.g. biofeedback data output at step 350*a* of method 300*a*) and a model of human sexual response. As described earlier, according to some embodiments the processing device may be PMD 100 (with associated processor unit 180). However, according to some embodiments, the processing device may be another computing device (e.g. computing device 204 as shown in FIG. 2). According to some embodiments, processing may occur in distributed manner over multiple devices.

It shall be understood that a sexual response profile may represent a distillation of the biofeedback data to a form that is more clearly indicative of the response, specifically the sexual response, of the person using the PMD 100. The sexual response profile of the person may be generated and updated in real time based on the biofeedback data and a model of human sexual response against which the gathered biofeedback data may be placed in context.

As a simplified example, general human sexual response is understood by some to comprise at least four stages or phases forming a cycle: excitement, plateau, orgasm, and resolution. This cycle of human sexual response was first proposed by William H. Masters and Virginia E. Johnson in their book "Human Sexual Response" (Bantam, 1981; 1st ed. 1966). According to this model, the excitement phase may be characterized by an increase in heart rate, blood pressure, and temperature at the skin due to flushing. An increase in muscle activity and tone (described generally as myotonia) occurring both voluntarily and involuntarily may begin during this phase. The excitement phase is further characterized by swelling (through vasocongestion) of tissue in and around the reproductive organs. The plateau phase represents the phase prior to climax or orgasm and may be characterized by even further increases in muscle tension, heart rate, and blood pressure. Orgasm occurs at the conclusion of the plateau phase and may be characterized by even further increases in heart rate and blood pressure as well as sudden involuntary muscle contractions in and around the reproductive organs as well as vocalizations in some instances and muscle spasms in other parts of the body. The resolution phase follows orgasm and is characterized by a slow down or lessening of the above described physiological responses as the body returns to a pre-excitement state. A person having ordinary skill in this area will recognize that the above provides an over simplified description of human sexual response. In fact, specifics of response may vary widely from person to person. However, the above provides a conceptualization of what may comprise a model of human sexual response. According to some embodiments, a model of human sexual response may be static and pre-defined, based on historical data gathered during previous scientific testing. According to some embodiments, a model of human sexual response may be dynamically constructed using machine learning algorithms as new data is gathered. For example, via the data aggregation processes described in more detail herein.

Therefore, according to some embodiments, the process of generating a sexual response profile may involve analyzing the biofeedback data against a model of human sexual response to produce distilled information that is indicative of the person's overall response. A person having ordinary skill will recognize that this may involve data analysis and processing methods described earlier with reference to method 300*a* as outlined in FIG. 3A.

As shown in FIG. 3B, according to some embodiments, the method of generating the sexual response profile for a person using a PMD 100 may comprise, at step 312*b*: correlating one or more sensor profiles included in the biofeedback data (e.g. correlating heart rate with pressure data indicating muscle contractions), at step 314*b*: identifying characteristic patterns in the correlated biofeedback data that are indicative of a sexual response to stimulation, at step 316*b*: analyzing those identifiable patterns against a model of human sexual response, and at step 318*b*: generating response profile based on that analysis.

The resulting sexual response profile may, according to some embodiments, be generated as a chart over time displaying a sexual response index value (based in some way on the combined biofeedback data) charted over a period of time (e.g. over a full session from excitement, through plateau, to orgasm, through resolution). For example, as displayed via dashboard 600 as 620.

Optionally, at step 320*b*, the sexual response profile may be presented to a user via a computing device (e.g. computing device 204 as shown in FIGS. 2-3). As described earlier, and with reference to FIG. 6, a sexual response profile 620 may be presented visually to a user as part of a dashboard 600 via a display of computing device 204. As shown in FIG. 6, according to some embodiments, computing device 204 may be a tablet device with a touch screen (e.g., an iPad®). Specifically, dashboard 600 may present, among other data, the sexual response profile 620. It shall be noted that FIG. 6 represents a simplified example embodiment for illustrative purposes, and is not to be construed as limiting. A person having ordinary skill in the art will recognize that there are any number of ways in which to present a sexual response profile graphically (or otherwise) via a computing device 204. Visualization software may be configured to present the sexual response profile differently depending on the use of the data, the intended audience, capabilities of the computing device, etc. For example, according to some embodiments, a "user" viewing the biofeedback data may be the person using the PMD 100. Here, a person using the PMD 100 may wish to view real-time sexual response profile via a smart watch that they are wearing in order to augment their experience (it may be exciting to the person to "view" their physiological response to stimulation in real time). The limits of the display of the smart watch would of course factor into the way the data is displayed, as would the person's technical understanding. In other words, highly complex charts may be difficult for a person with little scientific training to decipher. However, a simple presentation of data associated with the sexual response profile indicating level of excitement may be presented to augment the user's experience. Alternatively, according to some embodiments, the "user" viewing the biofeedback data may be a scientific researcher or physician viewing the data via a tablet device while a person (the subject or patient) uses a PMD 100. Of course, in such embodiments, biofeedback data may be presented in a highly detailed fashion so that the user may gain useful insight from the data.

Figure 3C:
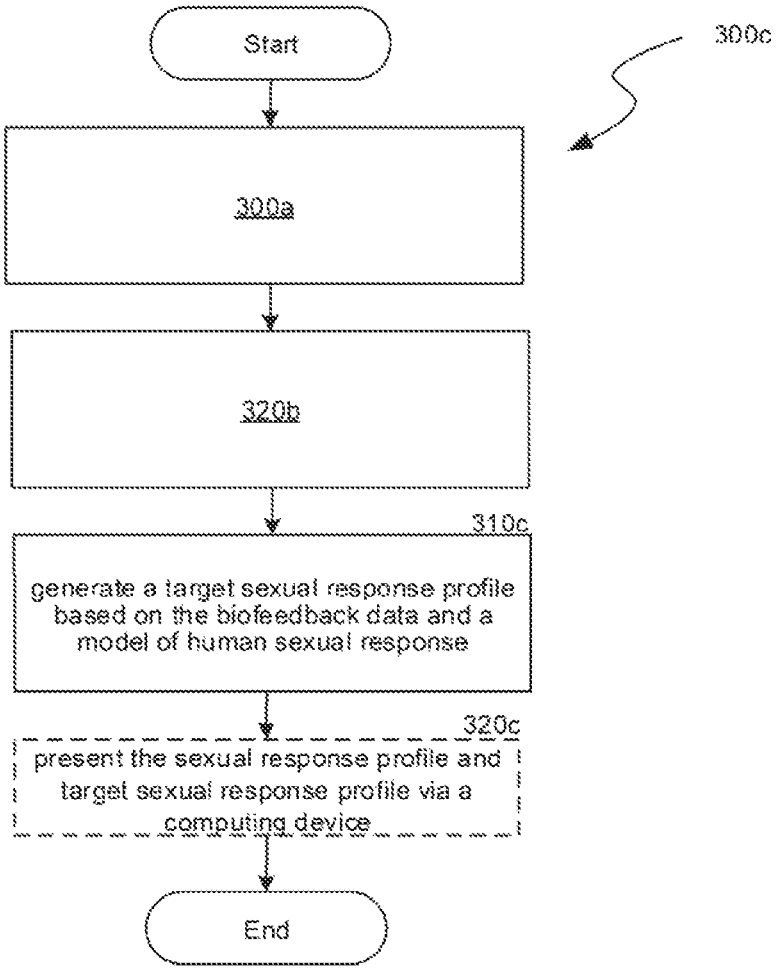
FIG. 3C depicts a flow chart of an example method for analyzing sexual response using a PMD, according to some embodiments.

FIG. 3C illustrates a flow chart for an example for method 300*c* for analyzing sexual response using a PMD 100 which builds upon example methods 300*a*-300*b* as illustrated in FIGS. 3A-3B.

At step 310*c* after having output biofeedback data and generating a sexual response profile, according to some embodiments, a target sexual response profile may be generated based on the biofeedback data and the model of human sexual response. According to some embodiments, the target sexual response profile may include information intended to guide a person using a PMD 100 to achieve a target sexual response. For example, consider the sexual response profile represented as a chart of a sexual response index value plotted over a time period as shown in sexual response profile chart 620 in FIG. 6. Here, a target sexual response profile may include a template chart of a sexual response index value over time, over which the person's sexual response profile may be charted in real time. According to some embodiments, a target sexual response profile may include other information intended to guide the person to achieving a target sexual response. For example, it may include graphical animations or text based or audible instructions for using the PMD 100 to achieve a target sexual response.

Target response profiles may be used for a number of purposes. For example, they may be used to simply enhance the person's sexual experience while using the PMD 100, by guiding them to use the device in ways in which that had not previously. Alternatively, a target sexual response profile may be used as a therapeutic tool to provide guidance for people with varying sexual disorders to help achieve previously unattainable sexual responses.

Optionally, at step 320*c*, the target sexual response profile may be presented to a user via a computing device 204 just as the sexual response profile is presented at step 320*b* in FIG. 3B. As already mentioned, a target sexual response profile may include a template chart of a sexual response index value over time, over which the person's sexual response profile may be charted in real time. However, it shall be understood that a template chart overlay illustrates a simplified example embodiment for illustrative purposes, and is not to be construed as limiting. A person having ordinary skill in the art will recognize that there are any number of ways in which to present a target sexual response profile graphically (or otherwise) via a computing device 204. Visualization software may be configured to present the target sexual response profile differently depending on the use of the data, the intended audience, the capabilities of the computing device, etc.

System for Analyzing Sexual Response—Large-Scale Data Aggregation and Analysis

Figure 4:
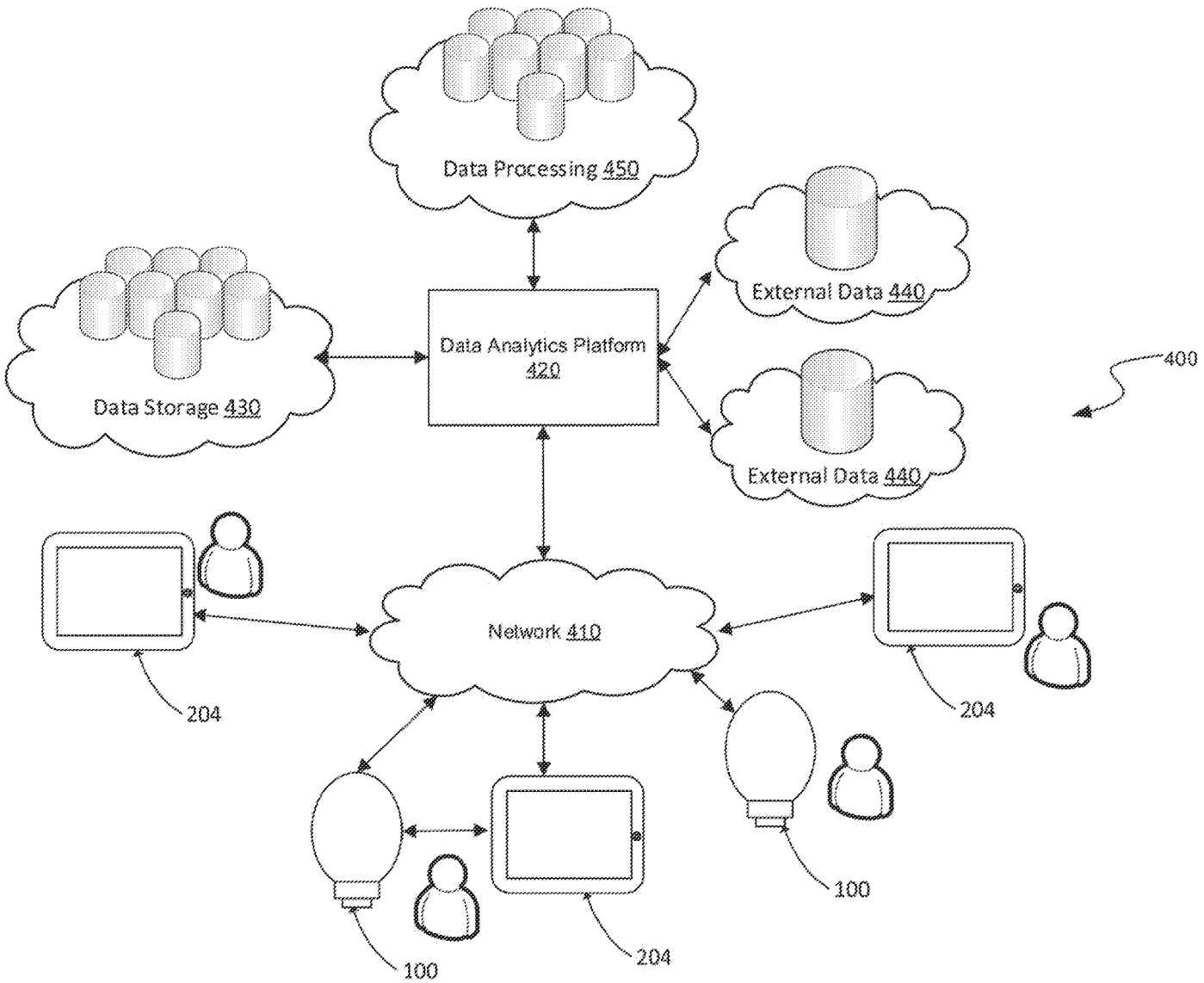
FIG. 4 depicts a high-level conceptual diagram of an example system for analyzing sexual response using PMDs and techniques of large-scale data aggregation and analysis, according to some embodiments.

FIG. 4 illustrates a conceptual diagram of an exemplary system 400 for analyzing sexual response using PMDs and techniques of large-scale data aggregation and analysis, according to some embodiments. According to some embodiments, biofeedback data based on sensor profiles received from sensors 140 while a person is using a PMD 100 may be transmitted to a data analytics platform, aggregated with biofeedback data from other people using other PMDs 100 and analyzed to create analyzed aggregated biofeedback data. Such analyzed aggregated biofeedback data may be used for a number of purposes, including but not limited to, studying human sexual response and generating models of human sexual response based on the aggregated biofeedback data of a large set of persons.

According to some embodiments, system 400 may include a plurality of PMDs 100 and computing devices 204 connected to a remote data analytics platform 420. Remote data analytics platform 420 may further comprise a data storage platform 430 and/or data processing platform 450 and access to external third-party data 440.

All of the aforementioned computing devices, including PMDs 100, computing devices 204 and any computing devices associated with data analytics platform 320, data storage/processing systems 430 and external data stores 440 may be connected to each other through one or more wired and/or wireless networks, for example network 410. In general, network 410 may be a cellular network, a telephonic network, an open network, such as the Internet, or a private network, such as an intranet and/or the extranet, or any combination or variation thereof. For example, the Internet can provide file transfer, remote log in, email, news, RSS, cloud-based services, instant messaging, visual voicemail, push mail, VoIP, and other services through any known or convenient protocol, such as, but is not limited to the TCP/IP protocol, Open System Interconnections (OSI), FTP, UPnP, iSCSI, NSF, ISDN, PDH, RS-232, SDH, SONET, etc.

The network 310 can be any collection of distinct networks operating wholly or partially in conjunction to provide connectivity the computing devices shown in FIG. 4 and may appear as one or more networks to the serviced systems and devices. In one embodiment, communications to and from the devices may be achieved by, an open network, such as the Internet, or a private network, such as an intranet and/or the extranet. In one embodiment, communications can be achieved by a secure communications protocol, such as secure sockets layer (SSL), or transport layer security (TLS).

In addition, communications can be achieved via one or more networks, such as, but are not limited to, one or more of WiMax, a Local Area Network (LAN), Wireless Local Area Network (WLAN), a Personal area network (PAN), a Campus area network (CAN), a Metropolitan area network (MAN), a Wide area network (WAN), a Wireless wide area network (WWAN), or any broadband network, and further enabled with technologies such as, by way of example, Global System for Mobile Communications (GSM), Personal Communications Service (PCS), Bluetooth, WiFi, Fixed Wireless Data, 2G, 2.5G, 3G (e.g., WCDMA/UMTS based 3G networks), 4G, IMT-Advanced, pre-4G, LTE Advanced, mobile WiMax, WiMax 2, WirelessMAN-Advanced networks, enhanced data rates for GSM evolution (EDGE), General packet radio service (GPRS), enhanced GPRS, iBurst, UMTS, HSPDA, HSUPA, HSPA, HSPA+, UMTS-TDD, 1×RTT, EV-DO, messaging protocols such as, TCP/IP, SMS, MMS, extensible messaging and presence protocol (XMPP), real time messaging protocol (RTMP), instant messaging and presence protocol (IMPP), instant messaging, USSD, IRC, or any other wireless data networks, broadband networks, or messaging protocols.

According to some embodiments, analytics platform 420 may include storage platform 430, processing platform 450 and one or more analytics engines (not shown). Data from PMDs 100 and computing devices 204 (e.g. raw sensor data and/or biofeedback data) and data form external data sources 440 (e.g. third-party data related to human sexuality such as scientific research data, biofeedback data from other devices/services, health records, statistical population data, survey data, and other big data sources) may be transmitted to data analytics platform 420 and stored on one or more storage devices, for example at a data storage platform 430, for aggregation and analysis.

According to some embodiments, access to analytics platform 320 may be provided by a third party as a service. For example, Google™ offers large-scale data analytics via Google BigQuery™. Using BigQuery in conjunction with Google cloud storage services, a user can analyze large-scale data sets through queries, for example SQL queries. Data to be analyzed using Google BigQuery may, for example, be stored on Google's cloud storage system as a comma-separated values (CSV) file. Another example of a third-party analytics platform is Amazon Redshift. According to some embodiments, a user may access and analyze data stored and aggregated at platform via a computing device (e.g., a computing device 204) using analytics software.

Data storage platform 430 may include a plurality of physical computing and storage devices functioning in a distributed manner offering virtualized off-premises data storage. According to some embodiments, a data storage platform 430 may be provided as a cloud storage service by a third-party hosting company. For example, Amazon Web Services™ offers a simple remote cloud storage service called Amazon S3™. According to some embodiments, a data storage platform 430 may be part of an analytics platform 420. While a storage platform 430 representing an off-premises staging area for data collected from sources 100, 204, and 440 may represent an efficient architecture for managing the collection of large sets of data for aggregation and analysis, a person having ordinary skill in the art will recognize that according to some embodiments, a data storage/processing platform 330 may not be necessary. For example, according to some embodiments, data from sources 100, 204 and 440 may be pulled or pushed directly into a real time processing pipeline associated with platform 420, without the need for staging at a storage platform 430.

Data analytics platform 420 may include a data processing platform 450 for aggregating and/or processing large-scale data sets (for example, those stored at storage platform 430). According to some embodiments, processing platform 450 may include one or more distributed computing clusters including one or more cluster controllers controlling one or more cluster nodes. Nevertheless, as described above, the PMD 100 may operate as a standalone device. As such, the PMD 100 can be configured to aggregate the data sets and perform all processing and analysis of the data internally to the PMD 100.

According to some embodiments, a cluster of commodity hardware server devices (nodes) may comprise the distributed computing cluster and may implement a distributed file system architecture such as the Hadoop Distributed File System (HDFS). HDFS is a distributed, file-system for the Apache Hadoop framework that has the capability of storing and processing large-scale data sets across multiple machines. HDFS achieves reliability by replicating the data across multiple host data nodes. Nodes can talk to each other to rebalance processing tasks, to move data around, and to keep the replication of data high. Data stored in an HDFS may be accessed via an application programming interface (API) (e.g., the Java API).

Processing platform 450 may include one or more job engines (not shown) to process data via the distributed file system. Job engines may be associated with the cluster and a processing pipeline. For example, the processing platform may be associated with a MapReduce engine to which client applications (e.g., a data analytics application instantiated at a computing device 204) may submit MapReduce jobs as part of a task to be performed at the cluster. MapReduce generally describes a programming model for processing large-scale data sets across multiple computing nodes that comprises two steps: a map step and a reduce step. At the map step, a cluster controller may intake a problem or query associated with a large-scale data set and divide the problem or query amongst the multiple computing nodes of the cluster. The multiple computing nodes may process the data and return the answer to the cluster controller. At the reduce step the cluster controller may collect the answers from the multiple nodes and combine into a single output.

FIG. 4 provides a conceptual diagram of data analytics platform 420, and it shall be understood that platform 420 may be composed of any combination of computing hardware and software, for example including hardware components as described with reference to FIG. 7. Further, it shall be understood that platform 420 may include components hosted at a single physical location or may include components distributed at multiple physical locations in communication with each other via, for example, network 410. It shall also be understood that platform 420 may include fewer or more components than as shown in FIG. 4. Users may access the functionality of analytics platform 420 via network 410 a number of ways, including, but not limited to via client software instantiated on a computing device 204, or via a web browser instantiated on computing device 204. In either case, access to the functionality of platform 420 may be provided via a graphical interface presented to users a computing device 204.

FIG. SA illustrates a flow chart of an example method 500*a* for analyzing sexual response using a PMD 100 using large-scale data aggregation and analysis which builds upon example method 300*a* as illustrated in FIG. 3A.

At step 510*a*, the biofeedback data output at step 300*a* (with reference to FIG. 3A) may be transmitted to a remote data analytics platform (e.g. platform 420) as previously described with reference to FIG. 4, for example via network 410.

At step 520*a*, biofeedback gathered from a particular PMD 100 data may be aggregated at the remote data analytics platform 420 with other data to an aggregated biofeedback data. The other data may include biofeedback data from other people, for example collected using other PMDs 100 or stored at a third-party external data store 404.

At step 530*a*, the aggregated biofeedback data may be analyzed and or processed to produce an analyzed or processed aggregated biofeedback data. According to some embodiments, analysis and processing may be performed by a distributed computing cluster (e.g. data processing platform 450 as shown in FIG. 4) and may employ analytics and processing techniques previously described with reference to FIG. 3A. According to other embodiments, as described above, the PMD 100 may operate as a standalone device. As such, the PMD 100 can be configured to aggregate the data sets and perform all processing and analysis of the data internally to the PMD 100.

At step 540*a*, an analyzed aggregated biofeedback data may be output from a processing pipeline associated with processing platform 550.

Analyzed aggregated biofeedback data may be used for a number of purposes. According to some embodiments, analyzed aggregated biofeedback data may be used in anonymizing data associated with sexual response characteristics of a large population set for further study by researchers into the physiological processes of human sexual response. According to some embodiments, analyzed aggregated biofeedback data may be used to dynamically generate or update a model of human sexual response (for example, as described earlier with reference to FIG. 3B)

Figure 5A:
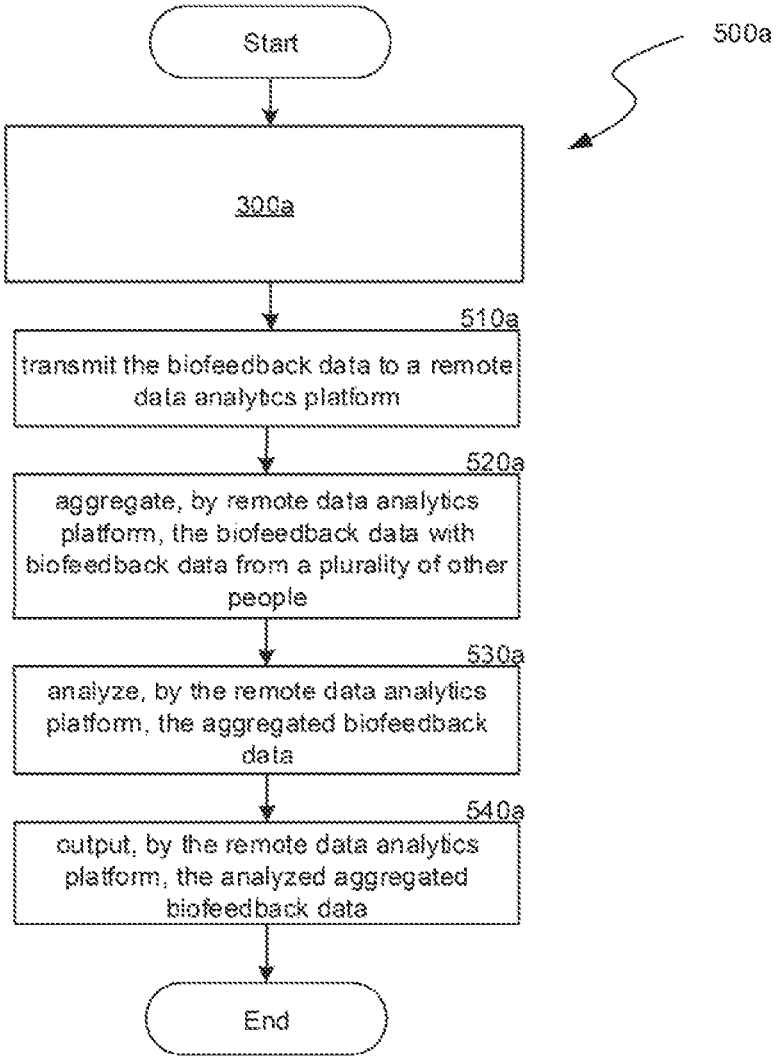
FIG. 5A depicts a flow chart of an example method for analyzing sexual response using a PMD and techniques of large-scale data aggregation and analysis, according to some embodiments.
Figure 5B:
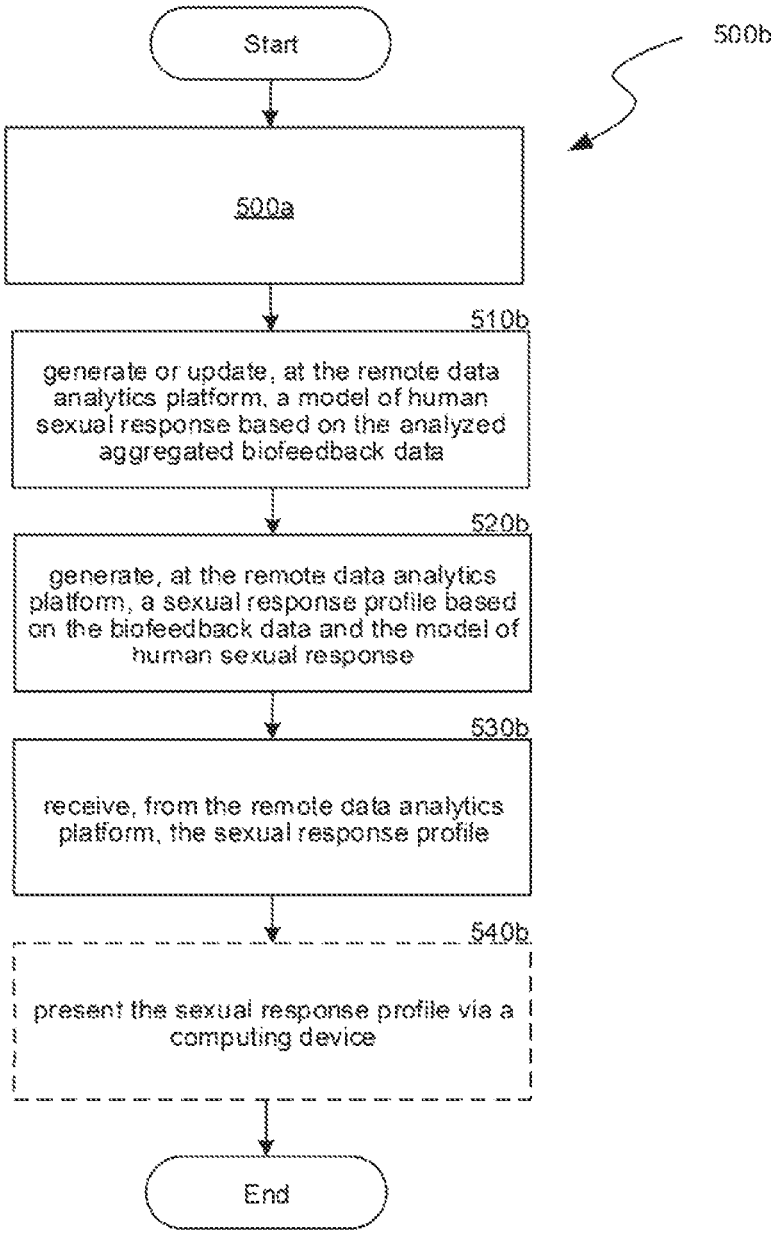
FIG. 5B depicts a flow chart of an example method for analyzing sexual response using a PMD and techniques of large-scale data aggregation and analysis, according to some embodiments.

FIG. 5B illustrates a flow chart of an example method 500*b* for analyzing sexual response using a PMD 100 using large-scale data aggregation and analysis which builds upon example method 500*a* as illustrated in FIG. 5A.

At step 510*b*, a model of human sexual response may be generated based on the analyzed aggregated biofeedback data output at step 500*a* in FIG. 5A. According to some embodiments, a model of human sexual response may be dynamically generated and updated at a remote data analytics platform using machine learning algorithms, as additional biofeedback data (e.g. from PMDs 100) is aggregated and analyzed. According to some embodiments, additional data from external sources 440 may also be aggregated and used to generate a model of human sexual response. For example, data at source 440 may include third-party data related to human sexuality such as scientific research data, biofeedback data from other devices/services, health records, statistical population data, survey data, and other big data sources.

At step 520*b*, a sexual response profile for the person using PMD 100 may be generated based on the biofeedback data original transmitted to remote data analytics platform 420 as described at step 510*a* in FIG. SA and model of human sexual response. In other words, instead of generating the sexual response profile using a processing unit of PMD 100 or a computing device 204 (as is described in FIG. 3A) this processing may be handed off to the cloud via platform 420.

At step 530*b*, the sexual response profile may be transmitted back to and received by PMD 100 and/or a computing device 204, for example, via network 410.

Optionally, at step 540*b*, the sexual response profile received from the remote data analytics platform 420 may be presented via a computing device similar to as described with reference to step 320*b* of FIG. 3B.

According to some embodiments the analyzed aggregated biofeedback data may be accessed via computing device 204. For example, a user of computing device 204 may be able to access subsets of the data as charts 650 part of dashboard 600 presented via the display of computing device 204. It shall be noted that FIG. 6 represents a simplified example embodiment for illustrative purposes, and is not to be construed as limiting. A person having ordinary skill in the art will recognize that there are any number of ways in which to present analyzed aggregated biofeedback data (or subsets thereof) via a computing device 204.

Background Information—Computer Systems/Devices

FIG. 7 shows a diagrammatic representation of a machine 700 in the example form of a computer system within which a set of instructions, for causing the machine to perform any one or more of the methodologies discussed herein, can be executed.

In alternative embodiments, the machine operates as a standalone device or can be connected (e.g., networked) to other machines. In a networked deployment, the machine can operate in the capacity of a server or a client machine in a client-server network environment, or as a peer machine in a peer-to-peer (or distributed) network environment.

The machine may be a server computer, a client computer, a personal computer (PC), a user device, a tablet, a phablet, a laptop computer, a set-top box (STB), a personal digital assistant (PDA), a thin-client device, a cellular telephone, an iPhone, an iPad, a Blackberry, a processor, a telephone, a web appliance, a network router, switch or bridge, a console, a hand-held console, a (hand-held) gaming device, a music player, any portable, mobile, hand-held device, or any machine capable of executing a set of instructions (sequential or otherwise) that specify actions to be taken by that machine.

While the machine-readable medium or machine-readable storage medium is shown in an exemplary embodiment to be a single medium, the term "machine-readable medium" and "machine-readable storage medium" should be taken to include a single medium or multiple media (e.g., a centralized or distributed repository, and/or associated caches and servers) that store the one or more sets of instructions. The term "machine-readable medium" and "machine-readable storage medium" shall also be taken to include any medium that is capable of storing, encoding or carrying a set of instructions for execution by the machine and that cause the machine to perform any one or more of the methodologies of the presently disclosed technique and innovation.

In general, the routines executed to implement the embodiments of the disclosure, can be implemented as part of an operating system or a specific application, component, program, object, module or sequence of instructions referred to as "computer programs." The computer programs typically comprise one or more instructions set at various times in various memory and storage devices in a computer, and that, when read and executed by one or more processing units or processors in a computer, cause the computer to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices, floppy and other removable disks, hard disk drives, optical disks (e.g., Compact Disk Read-Only Memory (CD ROMS), Digital Versatile Disks, (DVDs), etc.), among others, and transmission type media such as digital and analog communication links.

The network interface device enables the machine 600 to mediate data in a network with an entity that is external to the host server, through any known and/or convenient communications protocol supported by the host and the external entity. The network interface device can include one or more of a network adaptor card, a wireless network interface card, a router, an access point, a wireless router, a switch, a multilayer switch, a protocol converter, a gateway, a bridge, bridge router, a hub, a digital media receiver, and/or a repeater.

The network interface device can include a firewall which can, in some embodiments, govern and/or manage permission to access/proxy data in a computer network, and track varying levels of trust between different machines and/or applications. The firewall can be any number of modules having any combination of hardware and/or software components able to enforce a predetermined set of access rights between a particular set of machines and applications, machines and machines, and/or applications and applications, for example, to regulate the flow of traffic and resource sharing between these varying entities. The firewall can additionally manage and/or have access to an access control list which details permissions including for example, the access and operation rights of an object by an individual, a machine, and/or an application, and the circumstances under which the permission rights stand.

Other network security functions can be performed or included in the functions of the firewall, can be, for example, but are not limited to, intrusion-prevention, intrusion detection, next-generation firewall, personal firewall, etc. without deviating from the novel art of this disclosure.

The various example embodiments disclosed herein include the following example embodiments:

A method for analyzing a sexual response of a person using a personal massaging device, the method comprising: receiving a plurality of sensor profiles from a plurality of sensors associated with the personal massaging device, while the person is using the personal massaging device; wherein, one or more of the plurality of sensor profiles are associated with the person's response to a stimulus provided by the personal massaging device; wherein, one or more of the plurality of sensor profiles are associated with the position, orientation, or motion of the personal massaging device; wherein the stimulus is configured to stimulate the sexual response by the person; analyzing the plurality of sensor profiles; determining a biofeedback data based on the analysis of the plurality of sensor profiles; and outputting the biofeedback data.

The method as claimed above, wherein the plurality of sensors include one or more of the following: electrical potential sensors, optical sensors, pressure sensors, and thermal sensors.

The method as claimed above, wherein the plurality of sensors include one or more of the following: accelerometers, global position system (GPS), and proximity sensors.

The method as claimed above, wherein the biofeedback data includes information on one or more of the following: heart rate, oxygen level, applied pressure, and temperature.

The method as claimed above, further comprising: adjusting the stimulus provided by the personal massaging device based on biofeedback data.

The method as claimed above, further comprising: generating a sexual response profile of the person based on the biofeedback data and a model of human sexual response.

The method as claimed above, wherein generating the sexual response profile comprises: correlating one or more of the sensor profiles included in the biofeedback data; identifying a characteristic pattern in the biofeedback data indicative of a sexual response based on the correlating one or more sensor profiles; analyzing the characteristic pattern against the model of human sexual response; and generating the sexual response profile for the person based on the analysis of the characteristic pattern.

The method as claimed above, wherein the model of human sexual response is based on historical data.

The method as claimed above, wherein the model of human sexual response is based on aggregated biofeedback data from a plurality of people and dynamically constructed over time using machine learning algorithms.

The method as claimed above, wherein the model of human sexual response is based on aggregated biofeedback data from one or more users of the personal massaging device and the model of human sexual response is dynamically constructed internally to the personal massaging device over time using machine learning algorithms.

The method as claimed above, wherein the sexual response profile maps phases of the person's sexual response to the stimulus, wherein the phases include, excitement, plateau, orgasm, and resolution.

The method as claimed above, wherein the biofeedback data and sexual response profile are presented to a user via a computing device.

The method as claimed above, wherein the biofeedback data and sexual response profile are dynamically generated internally to the personal massaging device.

The method as claimed above, further comprising: adjusting the stimulus provided by the personal massaging device based on the generated sexual response profile.

The method as claimed above, further comprising: generating a target sexual response profile based on the biofeedback data and the model of human sexual response; wherein the target sexual response profile includes information intended to guide the person to achieving the target sexual response.

The method as claimed above, wherein the sexual response profile and target sexual response profile are presented to a user via a computing device.

The method as claimed above, wherein the sexual response profile and target sexual response profile are generated by processing and analysis of the data performed internally to the personal massaging device.

The method as claimed above, further comprising: transmitting the biofeedback data to a remote data analytics platform; wherein, the biofeedback data is aggregated at the remote data analytics platform with other biofeedback data from a plurality of other people to form an aggregate biofeedback data; wherein, the aggregate biofeedback data is analyzed at the remote data analytics platform; and wherein, an analyzed aggregated biofeedback data is output at the remote data analytics platform based on the analysis of the aggregate biofeedback data.

The method as claimed above, further comprising: receiving a sexual response profile of the person from the remote data analytics platform; wherein the sexual response profile is generated at the remote data analytics platform based on the biofeedback data and a model of human sexual response; wherein the model of human sexual response is generated at the remote data analytics platform based on the analyzed aggregated biofeedback data.

A system for analyzing a sexual response of a person the system comprising: a means for, receiving a plurality of sensor profiles from a plurality of sensors associated with a personal massaging device, while the person is using the personal massaging device; wherein, one or more of the plurality of sensor profiles are associated with the person's response to a stimulus provided by the personal massaging device; wherein, one or more of the plurality of sensor profiles are associated with the position, orientation, or motion of the personal massaging device; wherein the stimulus is configured to cause the sexual response by the person; a means for, analyzing the plurality of sensor profiles; a means for, determining a biofeedback data based on the analysis of the plurality of sensor profiles; and a means for, outputting the biofeedback data.

The system as claimed above, further comprising: a means for presenting the biofeedback data to a user.

The system as claimed above, wherein the biofeedback data is dynamically generated internally to the personal massaging device.

The system as claimed above, further comprising: a means for adjusting the stimulus of the personal massaging device based on the biofeedback data.

The system as claimed above, further comprising: a means for generating a sexual response profile of the person based on the biofeedback data and a model of human sexual response.

The system as claimed above, wherein the biofeedback data and sexual response profile are dynamically generated internally to the personal massaging device.

The system as claimed above, further comprising: a means for generating a target sexual response profile based on the biofeedback data and the model of human sexual response; wherein the target sexual response profile includes information intended to guide the person to achieving the target sexual response.

The system as claimed above, further comprising: a means for presenting the sexual response profile and target sexual response profile to a user.

The system as claimed above, wherein the sexual response profile and target sexual response profile are generated by processing and analysis of the data performed internally to the personal massaging device.

The description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions will control.

In general, the routines executed to implement the embodiments of the disclosure, can be implemented as part of an operating system or a specific application, component, program, object, module or sequence of instructions referred to as "computer programs." The computer programs typically comprise one or more instructions set at various times in various memory and storage devices in a computer, and that, when read and executed by one or more processing units or processors in a computer, cause the computer to perform operations to execute elements involving the various aspects of the disclosure.

Moreover, while embodiments have been described in the context of fully functioning computers and computer systems, those skilled in the art will appreciate that the various embodiments are capable of being distributed as a program product in a variety of forms, and that the disclosure applies equally regardless of the particular type of machine or computer-readable media used to actually effect the distribution.

Further examples of machine-readable storage media, machine-readable media, or computer-readable (storage) media include, but are not limited to, recordable type media such as volatile and non-volatile memory devices, floppy and other removable disks, hard disk drives, optical disks (e.g., Compact Disk Read-Only Memory (CD ROMS), Digital Versatile Disks, (DVDs), etc.), among others, and transmission type media such as digital and analog communication links.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number can also include the plural or singular number respectively. The word "or," in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize. For example, while processes or blocks are presented in a given order, alternative embodiments can perform routines having steps, or employ systems having blocks, in a different order, and some processes or blocks can be deleted, moved, added, subdivided, combined, and/or modified to provide alternative or subcombinations. Each of these processes or blocks can be implemented in a variety of different ways. Also, while processes or blocks are at times shown as being performed in series, these processes or blocks can instead be performed in parallel, or can be performed at different times. Further, any specific numbers noted herein are only examples: alternative implementations can employ differing values or ranges.

The teachings of the disclosure provided herein can be applied to other systems, not necessarily the system described above. The elements and acts of the various embodiments described above can be combined to provide further embodiments.

Any patents and applications and other references noted, including any that can be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes some embodiments of the disclosure, and describes the best mode contemplated, no matter how detailed the above appears in text, the teachings can be practiced in many ways. Details of the system can vary considerably in its implementation details, while still being encompassed by the subject matter disclosed herein. As noted above, particular terminology used when describing some features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

While some aspects of the disclosure may be presented herein in some claim forms, the inventors contemplate the various aspects of the disclosure in any number of claim forms. For example, while only one aspect of the disclosure is recited as a means-plus-function claim under 35 U.S.C. § 112(f), other aspects can likewise be embodied as a means-plus-function claim, or in other forms, such as being embodied in a computer-readable medium. (Any claims intended to be treated under 35 U.S.C. § 112(f) will begin with the words "means for".) Accordingly, the applicant reserves the right to add additional claims after filing the application to pursue such additional claim forms for other aspects of the disclosure.

What is claimed is:

1. A personal massaging device comprising:

a stimulus device configured to stimulate a sexual response by a person;

one or more sensors configured to collect biofeedback data of the person during an arousal episode;

a processor; and a memory unit having instructions stored thereon which when executed by the processor cause the processor to:

convert real-time biofeedback data of the person collected by the one or more sensors into a response index value;

generate an arousal profile based on a plot of multiple response index values that are collected over time during the arousal episode; and identify a given response index value of climax within the arousal profile.

2. The personal massaging device of claim 1, wherein the one or more sensors include any of: electrical potential sensors, optical sensors, pressure sensors, and thermal sensors, accelerometers, global position system (GPS), or proximity sensors.

3. The personal massaging device of claim 1, wherein the biofeedback data includes information types comprising any of: heart rate, oxygen level, applied pressure, or temperature.

4. The personal massaging device of claim 3, wherein the response index value is an amalgamation of available types of the biofeedback data.

5. The personal massaging device of claim 1, wherein the plot of the multiple response index values that are collected over time during the arousal episode is a first plot, the personal massaging device further comprising:

a display configured to render a second plot of a target response profile indicating aspirational response index values at a plurality of phases of sexual arousal as compared to the first plot.

6. The personal massaging device of claim 5, wherein the display is further configured to render active use feedback to the person based on a difference between the response index value and a corresponding index value on the target response profile.

7. The personal massaging device of claim 1, wherein the stimulus device is further configured to automatically adjust a stimulus action based on a difference between the response index value and a corresponding index value on a target response profile.

8. The personal massaging device of claim 1, further comprising:

a network interface configured to transmit the arousal profile to an external server that maintains a target response profile, wherein modifications to the target response profile are based on the arousal profile.

9. A method of operating a personal massaging device comprising:

executing a stimulus action on a person by a stimulus device configured to stimulate a sexual response;

collecting biofeedback data of the person during an arousal episode by one or more sensors;

converting real-time biofeedback data of the person collected by the one or more sensors into a response index value;

generating an arousal profile based on a plot of multiple response index values that are collected over time during the arousal episode; and identifying a given response index value of climax within the arousal profile.

10. The method of claim 9, wherein the response index value is an amalgamation of available types of the biofeedback data.

11. The method of claim 9, further comprising:

comparing the response index value to a corresponding index value on a target response profile indicating aspirational response index values at a plurality of phases of sexual arousal.

12. The method of claim 9, wherein the plot of the multiple response index values that are collected over time during the arousal episode is a first plot, the method further comprising:

displaying a second plot of a target response profile indicating aspirational response index values at a plurality of phases of sexual arousal as compared to the first plot.

13. The method of claim 12, further comprising:

issuing active use feedback to the person based on a difference between the response index value and a corresponding index value on the target response profile.

14. The method of claim 12, further comprising:

automatically adjusting the stimulus action based on a difference between the response index value and the target response profile.

15. The method of claim 12, further comprising:

transmitting the arousal profile to an external server that maintains the target response profile, wherein modifications to the target response profile are based on the arousal profile.

16. A personal massaging device comprising:

a stimulus device configured to stimulate a sexual response by a person;

one or more sensors configured to collect biofeedback data of the person during an arousal episode;

a processor; and a memory unit having instructions stored thereon which when executed by the processor cause the processor to:

convert real-time biofeedback data of the person collected by the one or more sensors into a response index value;

generate an arousal profile based on a plot of multiple response index values that are collected over time during the arousal episode; and compare the plot of the response index value to a target response profile, wherein the target response profile indicates aspirational response index values at a plurality of phases of sexual arousal.

17. The personal massaging device of claim 16, wherein the plot of the multiple response index values that are collected over time during the arousal episode is a first plot, the personal massaging device further comprising:

a display configured to render a second plot of the target response profile as compared to the first plot.

18. The personal massaging device of claim 17, wherein the display is further configured to render active use feedback to the person based on a difference between the response index value and the target response profile.

19. The personal massaging device of claim 17, wherein the stimulus device is further configured to automatically adjust a stimulus action based on a difference between the first plot and the target response profile.

20. The personal massaging device of claim 17, further comprising:

a network interface configured to transmit the arousal profile to an external server that maintains the target response profile, wherein modifications to the target response profile are based on the arousal profile.

* * * * *